United States Patent [19]

Uhlmann et al.

[11] 4,092,875

[45] June 6, 1978

[54] TUBE DRAWING METHOD AND APPARATUS

[75] Inventors: Otto Uhlmann, Burgdorf; Norbert Stephan, Hanover, both of Germany

[73] Assignee: Marshall Richards Barcro Limited, Crook, England

[21] Appl. No.: 767,761

[22] Filed: Feb. 11, 1977

[30] Foreign Application Priority Data

Feb. 20, 1976 Germany ..... 2606809

[51] Int. Cl.[2] ..... B21C 1/10

[52] U.S. Cl. ..... 72/275; 72/280; 72/283; 72/289

[58] Field of Search ..... 72/278, 280, 281, 283, 72/284, 287, 289, 275

[56] References Cited

U.S. PATENT DOCUMENTS

| | | | |
|---|---|---|---|
| 1,935,726 | 11/1933 | Pierson | 72/289 |
| 3,159,271 | 12/1964 | Pfeiffer | 72/289 |
| 3,646,798 | 3/1972 | Alcock | 72/288 |
| 3,765,215 | 10/1973 | Martin | 72/283 |
| 3,812,702 | 5/1974 | Benteler et al. | 72/283 |

*Primary Examiner*—Michael J. Keenan

*Attorney, Agent, or Firm*—Prutzman, Hayes, Kalb & Chilton

[57] ABSTRACT

The invention is concerned with a method of and apparatus for the continuous drawing of metal tubing by the die and floating plug method using rotating drawing blocks to provide draughting tension. Tube lengths are processed joined end-to-end in sequential stages with accumulators provided between adjacent dies to permit the receipt of tubing from the upstream die and the supply of tubing to the downstream die to be at different rates. Each joint between lengths is broken upstream of a die but remade downstream thereof, the accumulator absorbing and supplying tube from/to adjacent blocks while the tube rejoining process is effected.

8 Claims, 6 Drawing Figures

TUBE DRAWING METHOD AND APPARATUS

Figure 1:
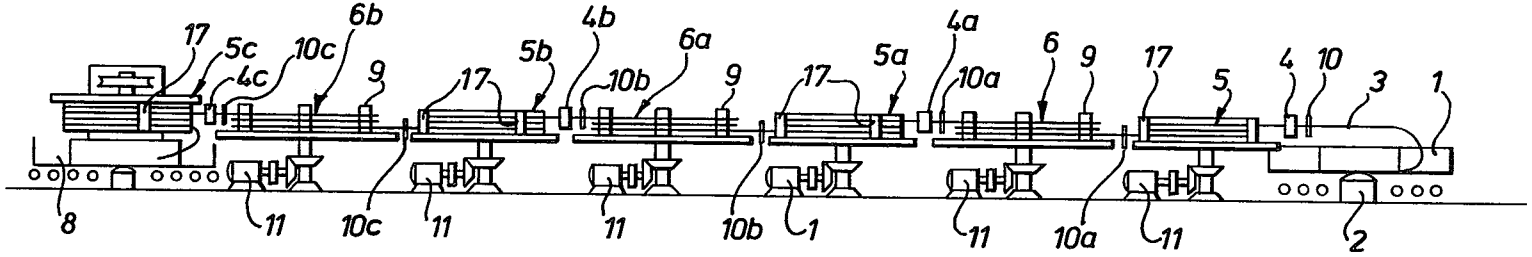

This invention relates to a method and apparatus for drawing tubes by means of drawing dies and floating plugs inserted within the tubes upstream of the respective dies, a rotating drawing block being employed downstream of the respective dies, whereby the tube is passed through a plurality of consecutively arranged drawing stages each comprising a drawing die and a drawing block.

In one known method of drawing tubular stock, this stock is drawn consecutively through at least two drawing dies. To apply the requisite draughting tension, drawing blocks are used, around which the drawn meterial is coiled. Thus a second drawing stage comprising a drawing die and a drawing block can be arranged immediately downstream of a first drawing block. The drawn tube from the first drawing block passes directly into the second drawing die, and from there on to the second drawing block, and so on. The drawing speed of each drawing stage is regulated in this method in accordance with the tension prevailing within the length of tube extending between two adjacent stages in that an upstream drawing stage will only operate when a certain degree of tensile stress in the tube leaving this unit is exceeded; thus each drawing stage only operates when the turns wound around its drawing block are sufficiently tight on the surface of this drawing block, by the drawing stage or stages placed downstream thereof, for force transmission to become possible. It is a disadvantage of this method that slip frequently occurs between the tube and the drawing block whereby the tube may be damaged. Such tube damage can be largely prevented by intensive lubrication, but this gives rise to the disadvantage that the tube is made very greasy or oily, and in consequence may become very dirty.

In the production of seamless metal tubes, the usual procedure is to take a block of metal, to press a bore in it to form an initial tube, and to roll down this initial tube to give a tube of enhanced length and having a smaller cross-section in a "pilgrim" machine and then to draw this pressed and rolled tube down through dies, in a plurality of drawing stages, to the desired final size and quality. Because the weight of the starting block cannot be made indefinitely large, one is restricted to relatively short pipe lengths from the "pilgrim" machine and with the subsequent drawing stages. The economy of this method of tube production, which is preferred in terms of cost, can be further improved if it is possible to increase the ratio of drawing time to down time of the drawing apparatus. Down time is the time spent in preparing the tube for a drawing stage and includes, for example, applying lubricant, introduction of the floating plug into the bore, pointing the leading end of the tube, introduction of the pointed leading end of the tube through the die, and engaging this pointed leading end in the clamp (or pulling-in dog) whereby it can be looped around the block.

It is an object of the present invention to enable the economics of this known tube drawing method to be improved, to enable the difficulties of the method mentioned earlier to be reduced if not eliminated, and to make it possible to produce a finished tube with a smooth clean surface.

According to the present invention there is provided a method of drawing tubes by means of drawing dies and floating plugs inserted within the tubes upstream of the respective dies, a driven drawing block being employed downstream of the respective dies, whereby the tube is passed through a plurality of consecutively arranged drawing stages each comprising a drawing die and a drawing block, in which method: the tube is fed into an accumulator downstream of each drawing stage but the last; the trailing end of each drawn tube length which is to be drawn further is secured downstream of the respective die to the leading end of an oncoming tube length which is to be drawn; and, upstream of the die of each drawing unit but the first, the joint between successive tube lengths is removed, but, after the introduction of a plug into the leading end of the oncoming tube length, these tube lengths are securely mechanically reconnected.

It is to be understood that the tube lengths fed into each accumulator should be sufficiently long to ensure that, during the preparation of each tube length for its next drawing operation, the next drawing unit downstream of the accumulator in question can continue to extract, out of the accumulator, tubing which is to be drawn.

In order that the requisite draughting tension shall be duly transmitted from one tube length to the next tube length, it is necessary for the connection between successive tube lengths to be mechanically secure. Thus, in a preferred procedure for reconnecting successive tube lengths, the leading end of the oncoming tube length is pointed, the pointed end thus formed is introduced into the trailing end of the preceding tube length, this trailing end being located downstream of the die whereby the oncoming tube length is to be drawn, and the reconnecting is thereupon effected by a compression joint. It is also possible, however, for the trailing end of the preceding tube and the leading end of the oncoming tube to be joined together by soldering, brazing or welding.

For carrying out the method of the present invention, use may be made of an apparatus which comprises a plurality of consecutively arranged drawing stages each comprising a drawing die and drawing block, in which apparatus: between each two drawing stages there is provided an accumulator; between each accumulator and the preceding drawing block there is arranged a dancing compensator regulating the tensile stress in the respective tubing; and each compensator is employed to control the used storage capacity of the respective accumulator. The accumulators may advantageously each comprise a core which is surrounded by the stored tube and which is variable in diameter. The diameter of the accumulator core is continuously increased when the preceding drawing block is forwarding the tube to the accumulator concerned, but the diameter and hence the used storage capacity are decreased when the preceding drawing block has been stopped to enable a joint to be made between successive lengths of tube.

Immediately downstream of each die there is preferably provided a tube clamping device. By means of this clamping device it is possible to maintain the firm winding of the turns of tube on the next drawing block, so that the latter can transmit the necessary tractive forces without difficulty at the start of the next drawing phase. Each tube clamping device preferably comprises two tube retaining assemblies which are arranged at spaced-apart locations along the lengthwise direction of the respective tubing and which are adapted to engage the tube and support the latter and additionally comprises separately actuated clamping jaws which are adapted to compress the tube and which are located between the two retaining assemblies. The clamping jaws are brought into action after the pointed leading end of an oncoming tube has been introduced into the trailing end of a preceding already drawn tube.

Preferably each of the drawing blocks is driven by a separate drive unit. Direct current electric motors are particularly suitable drive units for this purpose.

Because, in contrast with the above-mentioned prior art methods, the tube is virtually unstressed by forces between the individual drawing stages employed in accordance with the present invention, stationary pressure rollers pressing the turns of tube against the operative surface of the block may be provided around the circumference of each drawing block.

The invention will be explained more fully, by way of example, with reference to the accompanying diagrammatic drawings, in which:

FIG. 1 is a side view of an apparatus employed in drawing tubing by a method according to the present invention, and FIGS. 2 to 6 are fragmentary views on an enlarged scale showing certain stages in the procedure whereby successive lengths of tube are continuously passed through the apparatus shown in FIG. 1.

The manner in which the apparatus illustrated in FIG. 1 is started-up will be described first.

From a swift 1, which is mounted for free rotation on a wind-off mounting 2, the leading end of a length of tube 3 is taken, lubricated and a plug (not shown) is introduced into the bore of the tube. The tube end is then pointed and the pointed end passed through a drawing die 4. The pointed end of the tube 3 is engaged in a pulling-in dog (not shown) carried by a drawing block 5, and the tube 3 is drawn through the die 4 and wound around the body of the block 5 for the desired number of turns necessary to provide adequate draughting tension for the die 4. The tube is then released from the dog while pressure rollers 17 press the turns of the tube 3 against the operative surface of the block 5. Block 5 is rotated again and the tube upwound from it is passed to an accumulator 6, on which a plurality of turns of the drawn tube are accommodated. The pointed tip of the tube 3 carried by the accumulator 6 is cut off by the operative, the new end lubricated and another plug is introduced into the bore of the tube. The leading end of the tube is next repointed and led through a second drawing die **4*a*. A pulling-in dog (not shown) of a second drawing block 5*a* clamps the new pointed end and, as before, a desired number of turns of the tube are wound around the body of the second block 5*a*. In a series of operations similar to those just described, the leading end of the tube 3 is led to a second accumulator 6*a*, through a third die 4*b*, around a third drawing block 5*b*, around a third accumulator 6*b*, through a fourth die 4*c*, and around a fourth drawing block 5*c*. From this fourth drawing block 5*c*, the tube 3 is run continuously into a receptacle 8**. When a first length of tube has been threaded through all four dies in the manner described, continuous drawing can commence.

Immediately downstream of each of the first three dies 4, **4*a* and 4*b*, the trailing end of one length of tube 3 can be joined to the leading end of a new length of tube. For this purpose it is necessary to stop the respective downstream drawing block, but any preceding or upstream drawing block and the subsequent or downstream drawing block or blocks can continue drawing tube from the reservoir carried by the respective preceding accumulator. To allow for this the three accumulators 6, 6*a* and 6*b* are each provided with means for varying the winding diameter, comprising supports or segments 9, which are moved radially outwards when there is a net supply of tube to the accumulator concerned, but which are moved radially inwards when there is a net loss of tube (e.g. when the preceding drawing block has been stopped to enable a joint to be made between two lengths of tube). The control of the three accumulators 6, 6*a* and 6*b* is effected with the aid of dancing compensators 10, 10*a*, 10*b* and 10*c* provided between the drawing blocks and accumulators as shown in FIG. 1**.

Each of the four drawing blocks 5, **5*a*, 5*b* and 5*c* is driven from its own electric motor, as also are the three accumulators 6, 6*a* and 6*b*. If desired, the last drawing block 5*c*** may be replaced by an in-line drawing, straightening and sectioning unit, or by a level winder or "pancake" winder.

The method and apparatus of the invention can be employed in a particularly economic manner for the production of thin-walled tubes and/or tubes of small external diameter, for which the last drawing stages can be performed continuously. Here it is desirable that the drawing blocks should have the smallest possible mass but the greatest possible diameter. Guide grooves for guiding the tube 3 may be provided in the circumference of the drawing blocks. The drawing blocks may be upstanding or suspended, with a vertical axis; or they may have a horizontal axis; or again they may be disposed with their rotating axis obliquely inclined.

Figure 2:
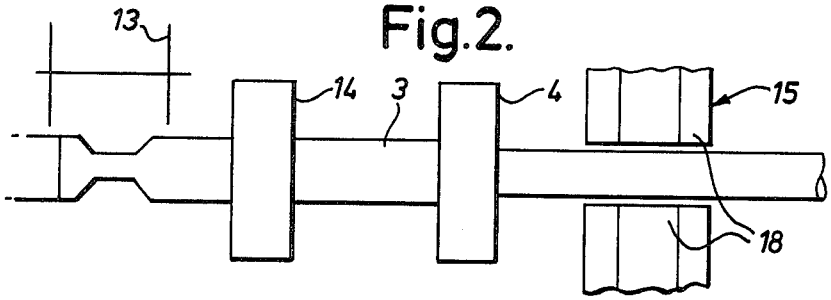
Figure 3:
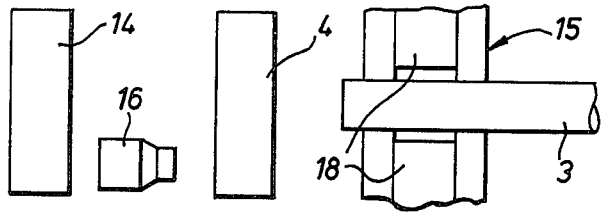
Figure 4:
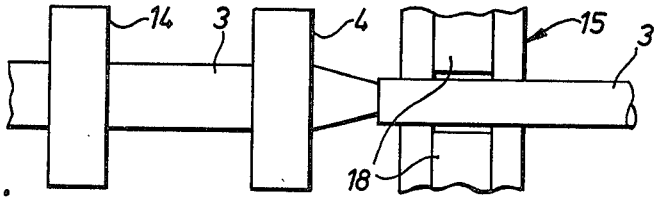
Figure 5:
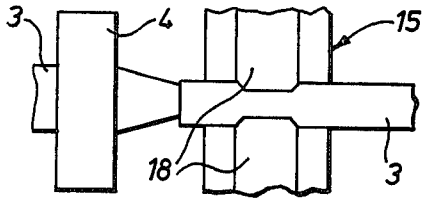
Figure 6:
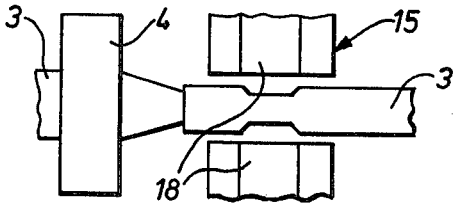

When a joint between two tube lengths lies just upstream of one of the dies **4*a*, 4*b* or 4*c*, the next adjacent drawing block on the downstream side is stopped, and the joint is cut out by means of a saw 13 (FIG. 2). The downstream drawing block then draws the tube 3 through a guide 14, and through the die 4 with which it cooperates, but the cut tube end is stopped immediately downstream of this die by means of a clamping device 15, so that the turns of tube wound around the drawing block remain in close contact with that block. As the cut end of the tube 3 leaves the die 4 under discussion, the plug 16 in its bore drops out (FIG. 3). The leading end of the next length is lubricated, the plug 16 (or a fresh plug) is inserted in its bore, the leading end of this oncoming tube length is pointed and the pointed end is inserted, through the guide 14 and the die 4, into the trailing end of the preceding tube length, retained in the clamping device 15 (see FIG. 4). The clamping device 15 has outer tube-retaining parts and at least two clamping jaws 18, actuated separately from the tube-retaining parts, whereby the trailing end of the preceding tube is made to firmly grip the pointed end of the oncoming length (see FIG. 5). After the completion of this joining operation, the jaws 18 and the tube-retaining parts of the clamping device 15 are opened (see FIG. 6) and the downstream drawing block is rotated once more. The deformed joint formed by the device 15** will next be stopped just before it reaches its next downstream die and the complete re-joining process described above is repeated.

It will be understood that no saw 13 is required before the first drawing drum since there is no deformed joint to cut off the trailing end of a new pipe length.

It is a particular advantage of the invention that a plurality of drawing stages can proceed at the same time, so that a considerable saving in drawing time can be achieved. Also the capital cost of apparatus in accordance with the invention is considerably less than that of a plurality of ordinary drawing apparatuses capable of giving the same product throughput. Furthermore, it is possible to operate the apparatus with a considerably smaller number of receptacles, and the space required is small.

What is claimed is:

1. A method of continuously drawing a succession of tube lengths having a plurality of successive drawing steps at a plurality of successive drawing stages respectively, each comprising a tube drawing die, a floating plug within the tube upstream of the die, and a downstream rotatable draw block operable for drawing the tube through the die, comprising the steps of selectively accumulating the tube between successive drawing stages while temporarily and separately discontinuing the drawing step at either stage and continuing the drawing step at the other stage; separately inserting each stage floating plug into the leading end of each oncoming tube length and then threading the leading end of the oncoming tube length through the die and if the oncoming tube length is a succeeding tube length, joining the leading end thereof to the trailing end of the preceding tube length, and operating the respective draw block for drawing the oncoming tube length through the die; and temporarily and separately discontinuing each drawing step and removing each end joint of successive tube lengths between stages, for the said inserting, threading and joining steps.

2. A method according to claim 1 wherein the joining step comprises pointing the leading end of the succeeding tube length, inserting the pointed leading end into the trailing end of the preceding tube length, and compressing said trailing end onto said leading end to form a compression joint.

3. A method of continuously drawing a succession of tube lengths in a plurality of successive drawing steps at a plurality of successive drawing stages respectively, each comprising a tube drawing die, a floating plug within the tube upstream of the die, and a downstream rotatable draw block operable for drawing the tube through the die, comprising the steps of selectively accumulating the tube between successive drawing stages while temporarily and separately discontinuing the drawing step at either stage and continuing the drawing step at the other stage; separately inserting each stage floating plug into the leading end of each oncoming tube length and then threading the leading end of the oncoming tube length through the die and joining it to the trailing end of the preceding tube length, and operating the respective draw block for drawing the oncoming tube length through the die; and temporarily and separately discontinuing each drawing step and removing each end joint of successive tubes between stages for said inserting, threading and joining steps.

4. A tube drawing system for continuously drawing a succession of tube lengths in a plurality of successive drawing steps and having a plurality of successive drawing stages for the plurality of successive drawing steps respectively each drawing stage comprising a tube drawing die, a floating plug adapted to be inserted within the tube upstream of the die, and a downstream rotatable draw block operable for drawing the tube through the die; accumulator means between each pair of consecutive stages for selectively accumulating tube between said stages for accomodating receiving tube from and supplying tube to the consecutive stages at substantially different rates and for continuing the drawing step at either stage while temporarily and separately discontinuing the drawing step at the other stage for disconnecting the tube lengths between stages, inserting the succeeding stage floating plug into the leading end of the oncoming tube length, threading it through the succeeding stage die and joining it to the trailing end of the preceding tube length; and dancing compensator regulating means for regulating the accumulation of the tube by each accumulator means for controlling the tension in the tube between the accumulator means and the preceding draw block for accomodating said temporary and separate discontinuance of said prior stage drawing step.

5. A tube drawing system according to claim 4 wherein each accumlator means comprises a core for receiving a plurality of tube coils thereon and having a variable diameter controlled by the regulating means for regulating said tube tension by regulating the length of tube accumulated on the core.

6. A tube drawing system according to claim 4 further comprising clamping means immediately downstream of each die for clamping the leading and trailing ends of successive tube lengths together to form a compression joint.

7. A tube drawing system according to claim 4 wherein a separate drive unit is provided for driving each rotatable draw block.

8. Apparatus suitable for the continuous drawing of lengths of tube comprising a plurality of consecutively arranged drawing stages each comprising a drawing die and a drawing block, in which apparatus: between each adjacent two drawing stages there is provided an accumulator for drawn tubing; between each accumulator and the preceding drawing block there is arranged a dancing compensator regulating the tensile stress in the respective tubing; and each compensator is employed to control the used storage capacity of the respective accumulator, and a tube clamping device immediately downstream of each die, comprising tube-retaining parts which are arranged at spaced-apart locations along the lengthwise direction of the tubing path and which are adapted to engage the tube and support the latter, and separately actuated clamping jaws which are disposed between the spaced-apart tube-retaining parts and which clamping jaws are adapted to compress the tube and effect a joint between adjacent tube lengths.

* * * * *